United States Patent [19]

Motodate

[11] Patent Number: 4,754,154

[45] Date of Patent: Jun. 28, 1988

[54] ELECTRIC GENERATOR FOR VEHICLES

[75] Inventor: Shoji Motodate, Saitama, Japan

[73] Assignee: Honda Giken Kogyo Kabushiki Kaisha, Tokyo, Japan

[21] Appl. No.: 902,994

[22] Filed: Sep. 2, 1986

[30] Foreign Application Priority Data

Sep. 2, 1985 [JP] Japan ..... 60-194602

[51] Int. Cl.[4] ..... F02N 11/04

[52] U.S. Cl. ..... 290/46; 290/31

[58] Field of Search ..... 290/22, 31, 46; 310/240

[56] References Cited

U.S. PATENT DOCUMENTS

| | | | |
|---|---|---|---|
| 3,577,002 | 5/1971 | Hall et al. | 290/46 |
| 3,590,262 | 6/1971 | Sheffield et al. | 290/46 |
| 3,879,624 | 4/1975 | Jones | 290/46 X |
| 4,219,739 | 8/1980 | Greenwell | 290/46 |

FOREIGN PATENT DOCUMENTS 25334 7/1986 Japan .

*Primary Examiner*—William M. Shoop, Jr.
*Assistant Examiner*—W. E. Duncanson, Jr.
*Attorney, Agent, or Firm*—Lyon & Lyon

[57] ABSTRACT

An electric generator for vehicles is disclosed including an armature having starting coils, generating coils and a starting current supply path assembly for supplying electrical current from a power supply to the starting coils. The electric generator also includes a field element having a set of field magnets for providing a magnetic field which interacts with the magnetic field of the starting coils during a start-up sequence of the engine of the vehicle. The field magnets also generate a magnetic field after the start-up sequence has been completed to induce an electrical current in the generating coils during operation of the engine so as to provide electrical energy for the engine. The starting coils are arranged concentrically inside the set of field magnets and the generating coils are arranged concentrically inside the starting coils. A magnet is also provided which causes the starting current supply path assembly and brushes made of conductive material to come into contact with each other during the start-up sequence so as to provide an electrical connection between the starting coils and the power source. After the start-up sequence is completed, the magnet which causes the connection between the starting current supply path assembly and the brushes is de-energized so as to break the connection. The rotor continues to rotate due to the operation of the engine.

30 Claims, 6 Drawing Sheets

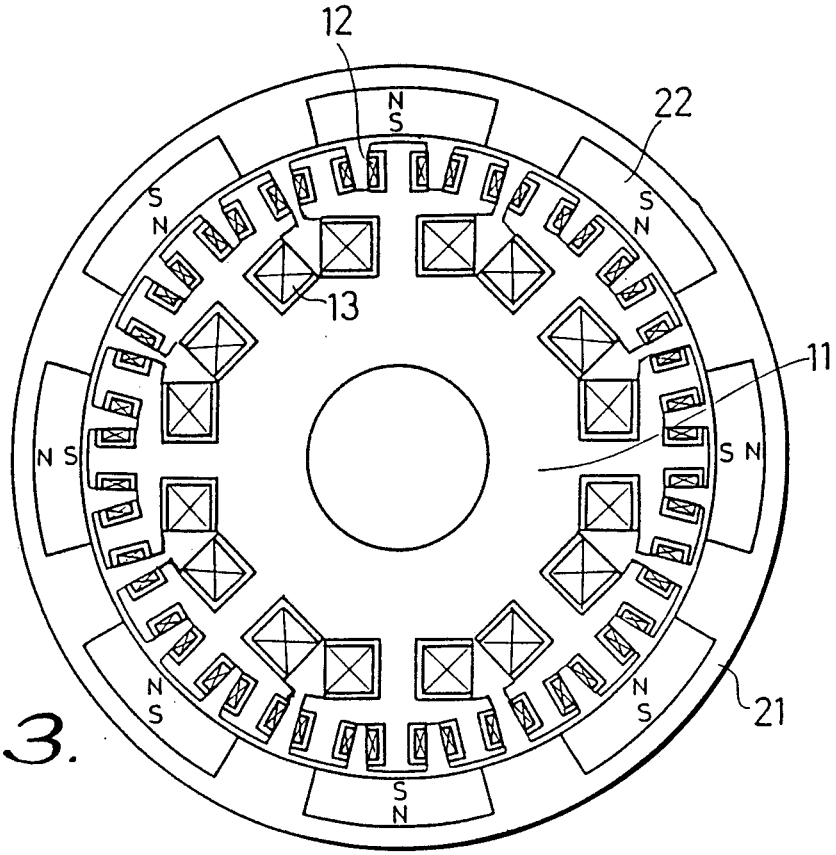
FIG. 3.
FIG. 5.
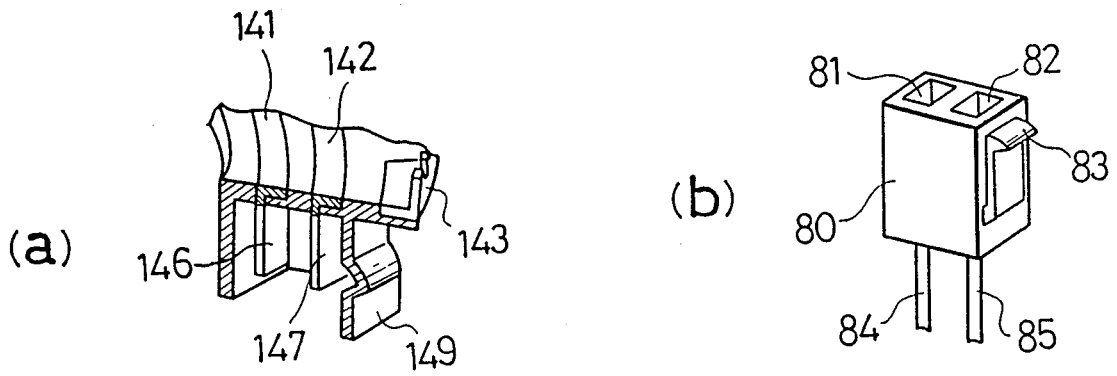

ELECTRIC GENERATOR FOR VEHICLES

BACKGROUND OF INVENTION

The field of the present invention is electric generators or dynamos for providing electric energy to vehicles such as motorcycles or automobiles.

A vehicular dynamo sometimes has an AC generator connected with an engine crankshaft and a so-called self-starter for starting the engine and is assembled integrally with speed reducing shafts, starting clutches, etc. Vehicular dynamos with self-starters usually have them located rearwardly along with other associated components thus significantly increasing the overall size of the dynamos.

SUMMARY OF THE INVENTION

The present invention relates to an electric generator with a self-starter. The electric generator has an armature with starting coils, generating coils and a starting current supply path assembly for supplying electric current from a power supply to the starting coils. The electric generator also has a set of field magnets and at least one magnet for electrically connecting the starting current supply path assembly to the power source. The starting coils are energized by the power source during a start-up sequence and a starting torque is generated by the attractive and repulsive forces caused by the magnetic field of the starting coils and the magnetic field of the set of field magnets. The set of field magnets also provides the generating magnetic field for the generating coils after the start-up sequence has been completed.

Among the advantages of the present invention is greater compactness and lower weight. Other and further advantages will appear hereinafter.

BRIEF DESCRIPTION OF THE DRAWINGS

FIG. 3 is a schematic sectional front view of certain components of the electric generator of FIG. 1.

FIG. 5*a* is a perspective view of one component of the electric generator of FIG. 4.

FIG. 5*b* is a perspective view of the adaptor plug illustrated in FIG. 4.

DETAILED DESCRIPTION OF THE PREFERRED EMBODIMENT

Figure 1:
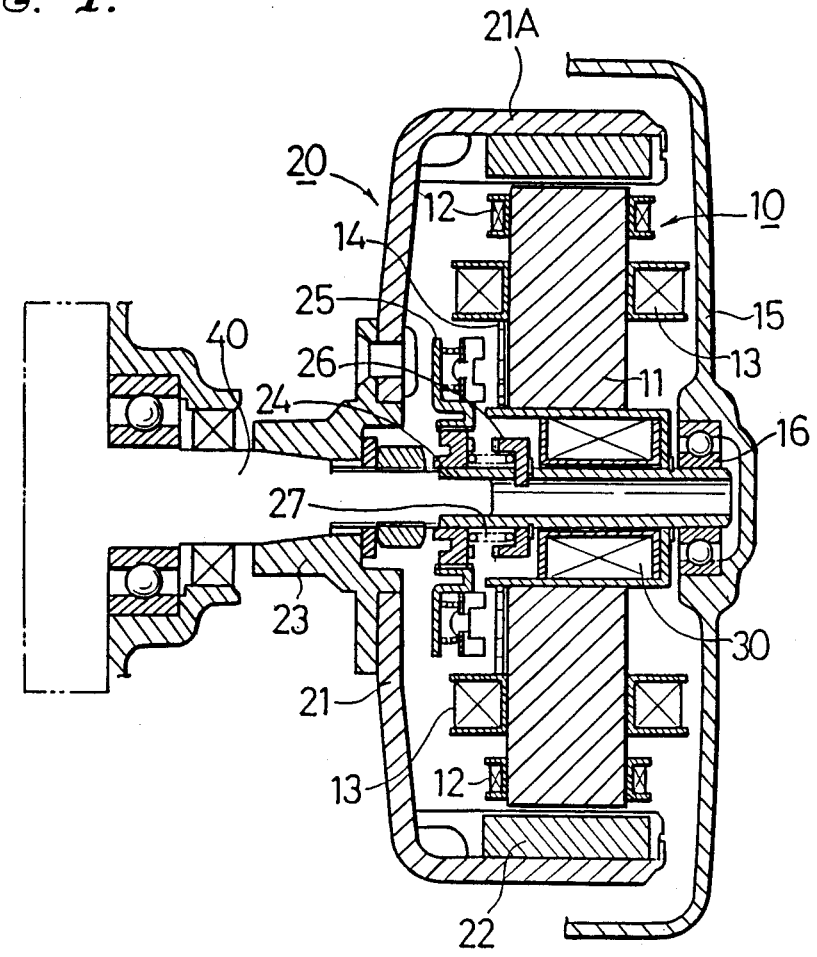
FIG. 1 is a sectional side view of an electric generator according to one embodiment of the present invention.

FIG. 1 is a cross-sectional view of one embodiment of the present invention. In the embodiment of FIG. 1, an armature 10 is a stator and a rotor 20 includes a field element, comprising a set of field magnets 22, and a magnet 30 for driving the brushes 252 (see FIG. 4). A crankshaft 40 of the engine turns the rotor shaft 24.

Figure 2:
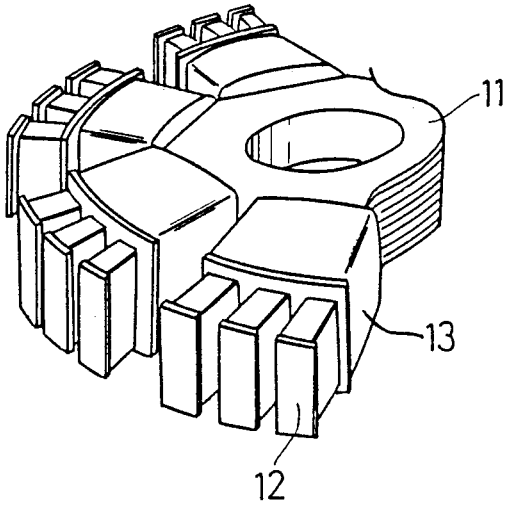
FIG. 2 is a perspective view of part of the armature of the electric generator of FIG. 1 illustrating its starting coils, generating coils and yoke frame.
Figure 4:
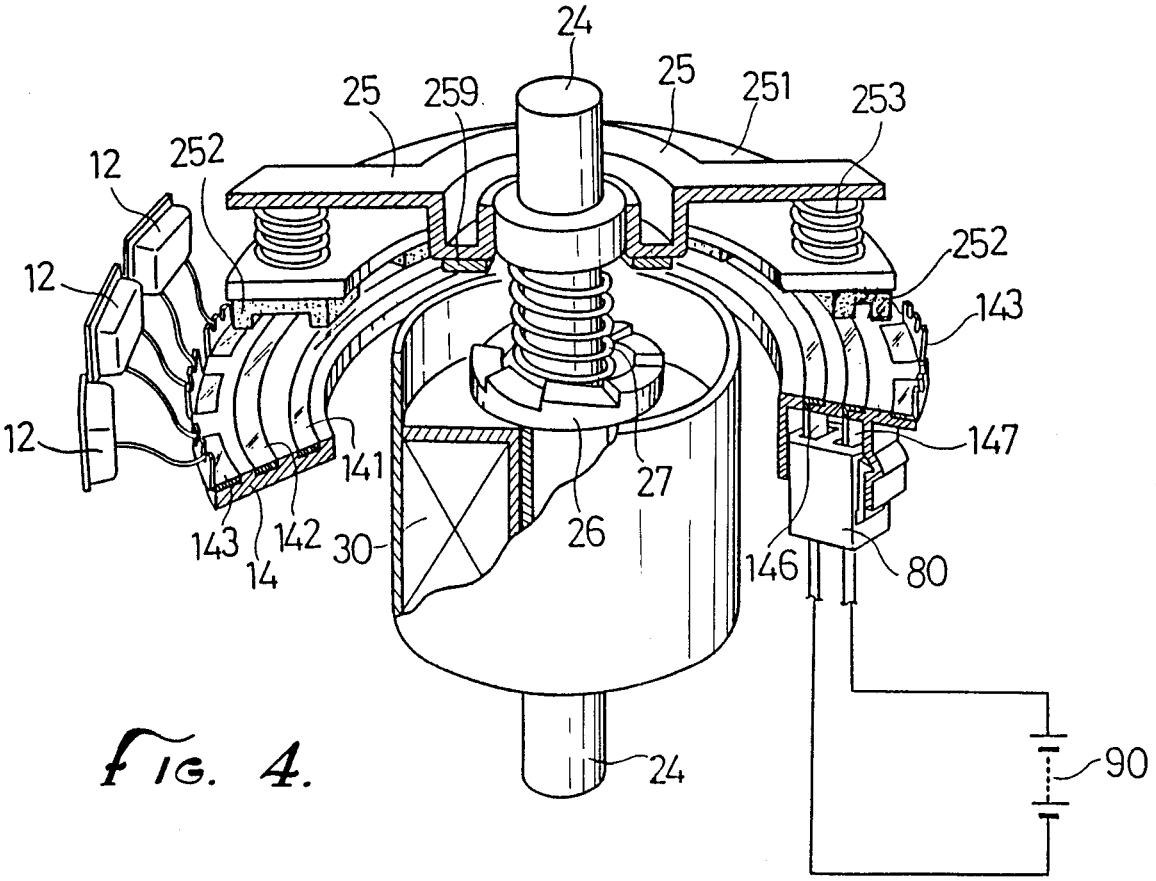
FIG. 4 is a perspective cut-away view of certain components of the electric generator of FIG. 1.

The armature 10 includes a plurality of starting coils 12 along the periphery of a disk-shaped yoke frame 11 and generating coils 13 located concentrically inside the starting coils 12. FIGS. 2 and 3 further illustrate the above components. Both coils 12 and 13 arranged in series in the same magnetic circuits. The starting coils 12 have fewer windings than the generating coils 13 but exceed the latter in number. In FIG. 3, corresponding to each of eight field magnets 22, each with a pair of magnetic poles, are two starting coils 12 and one generating coil 13, with another starting coil 12 located between each pair of magnetic poles. Turning to FIG. 4, the starting coils 12 are each electrically connected in series with one another through separate conduction paths 141, 142 and 143 of the starting current supply path assembly 14. Appropriate starting coils 12 are electrically connected by means of brushes 252 to the electrode of a power supply 90 having an appropriate polarity, as explained below.

The generating coils 13 may be connected in series or otherwise. The starting coils 12 may be connected either in series or in parallel with the generating coils 13 so that the starting coils 12 can serve as generating coils after the starting sequence has been completed. The starting current supply path assembly 14 is placed concentrically inside the generating coils 13, as illustrated in FIG. 4.

The starting current supply path assembly 14 has a first circular conduction path 141, a second circular conduction path 142 concentrically located outside the first path 141 and third conduction paths 143 separately distributed along the circumference of the second path 142. The first conduction path 141 is connected to the negative electrode of the power supply (e.g., the battery of the vehicle) 90 and the second conduction path is connected to the positive electrode of the power supply 90. The connection between these paths and the power supply 90 is made by pins 146 and 147 extending beneath the current supply path assembly 14. The pins 146 and 147 are received in an adapter plug 80.

The relationship between these pins 146 and 147 and the plug 80 is shown in FIGS. 5*a* and 5*b*. A stopper receiving member 149 is formed parallel to the pins 146 and 147 of the starting current supply path assembly 14. The member 149 and plug holder portions of the current supply path assembly 14 may be formed by plastic molding into a single unit together with any insulators for the power supply path assembly 14. The adapter plug 80 is provided with slots 81 and 82, as shown in FIG. 5*b*, for receiving the pins 146 and 147 in the plug 80. The plug 80 can be made of plastic. The slots 81 and 82 have conductive sleeves (not shown) for receiving the pins 146 and 147. The sleeves extend out of the plug 80 to furnish terminals 84 and 85 for electrical connection with the power supply 90. Provided on one side of the block is a stopper 83 which is plastic molded integrally with the block. The stopper 83 will fit the stopper receiving member 149 as the plug 80 is coupled with the pin 146 and 147 to establish a firm connection with the starting current supply path assembly 14.

The starting current supply path assembly 14 can be formed on an insulating thin plate by means of known electrode printing techniques.

Returning to FIG. 1, the rotor 20 has eight field magnets 22, each with a pair of magnetic poles, spaced equidistant from one another inside an end portion 21A of a cup-shaped frame 21. Although the pairs of magnetic poles result from permanent field magnets 22 in this example, they may be formed by electric coils. The field magnets 22 are arranged so that the opposite poles are alternately inverted and point radially inward toward the rotor shaft 24.

A flange cap 23 for receiving the crankshaft 40 of an engine is coaxially fixed on the frame 21 by means of rivets or the like. A rotor shaft 24 which is axially detachably coupled with the crankshaft 40 is received in the flange cap 23. The rotor shaft 24 is supported at one end thereof by bearings 16 mounted inside the cover frame 15 of the dynamo. The cover frame 15 in turn supports the armature 10.

A brush holder 25 for accommodating the brushes 252 is provided on the shaft 24 so that the brushes 252 can slide over a predetermined distance along the shaft 24 to make contact with the starting current supply path assembly 14. Driving gears 26 for driving the brush holder 25 are also mounted on the shaft 24. Provided between the brush holder 25 and the driving gear 26 is a coil spring for biasing the holder 25. Mounted between the brush holder driving gear 26 and the bearing 16 is an electromagnet 30. The electromagnet 30 does not rotate in this embodiment but it can be made rotatable as well.

Figure 6:
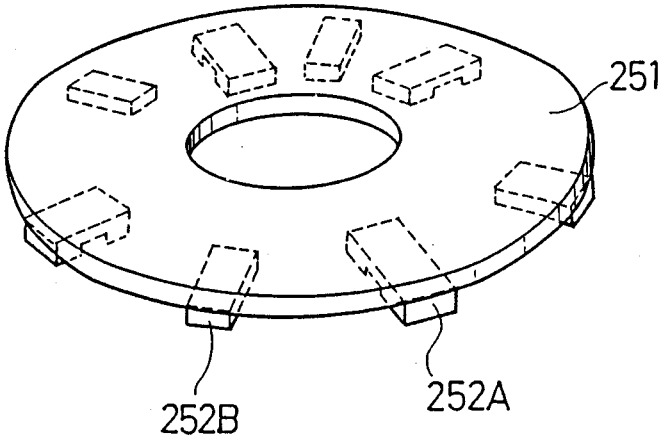
FIG. 6 is a perspective view of certain components of the electric generator of FIG. 4

The arrangement of the members associated with the brush holder is shown in FIGS. 4 and 6. The brush holder 25, made of a magnetic material and fixed on the shaft 24, supports an annular brush plate 251 by means of coil springs 253 which are arranged symmetrically about the rotary axis along the circumference of the holder 25.

Figure 8:
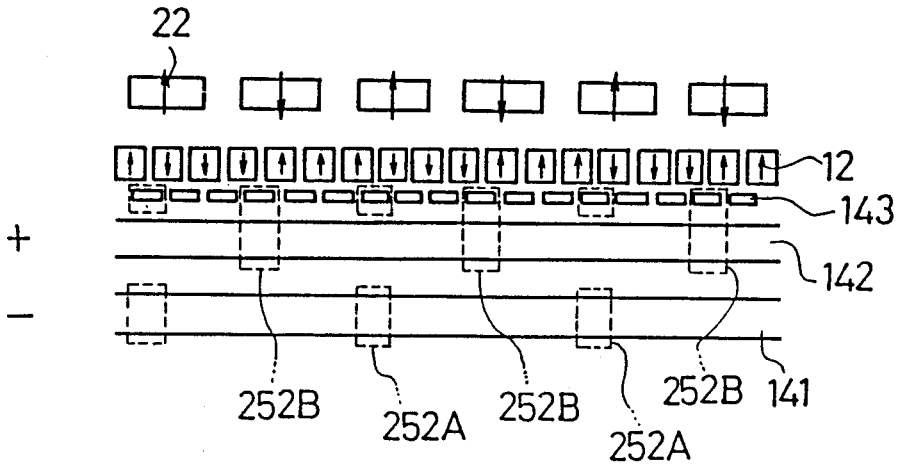
FIG. 8 is linear schematic drawing illustrating the operation of the electric generator of FIG. 1.

A multiplicity of brushes 252 are fixed on one side of the brush plate 251. Eight brushes, depicted as either 252A or 252B in FIG. 8, are alternately located on the brush plate 251. The brushes designated 252A connect the first and the third conduction paths 141 and 143 respectively of the starting current supply path assembly 14; alternately, the brushes designated 252B connect the second and the third conduction paths 142 and 143 respectively. The material of the brushes 252 may be any of those used in conventional rotational electric generators, so long as it has proper conductivity. The coil springs 253 are furnished to provide the pressure required for maintaining good contact between the brushes 252 and the starting current supply path assembly 14.

Close to the shaft 24, a gear 259 for engaging a brush holder driving gear 26 is provided on the brush holder 25. This gear 259 engages the brush plate driving gear 26 while the brush holder 25 is attracted to the energized magnet 30 against the force of the spring 27 thereby enabling the counterclockwise rotation of the rotor. During this period, the brushes 252 are in contact with the conduction paths 141, 142 and 143. When the electromagnet 30 is de-energized, the coil spring 27 is freed, disconnecting the brushes 252 from each of the conduction paths 141, 142 and 143.

Figure 7:
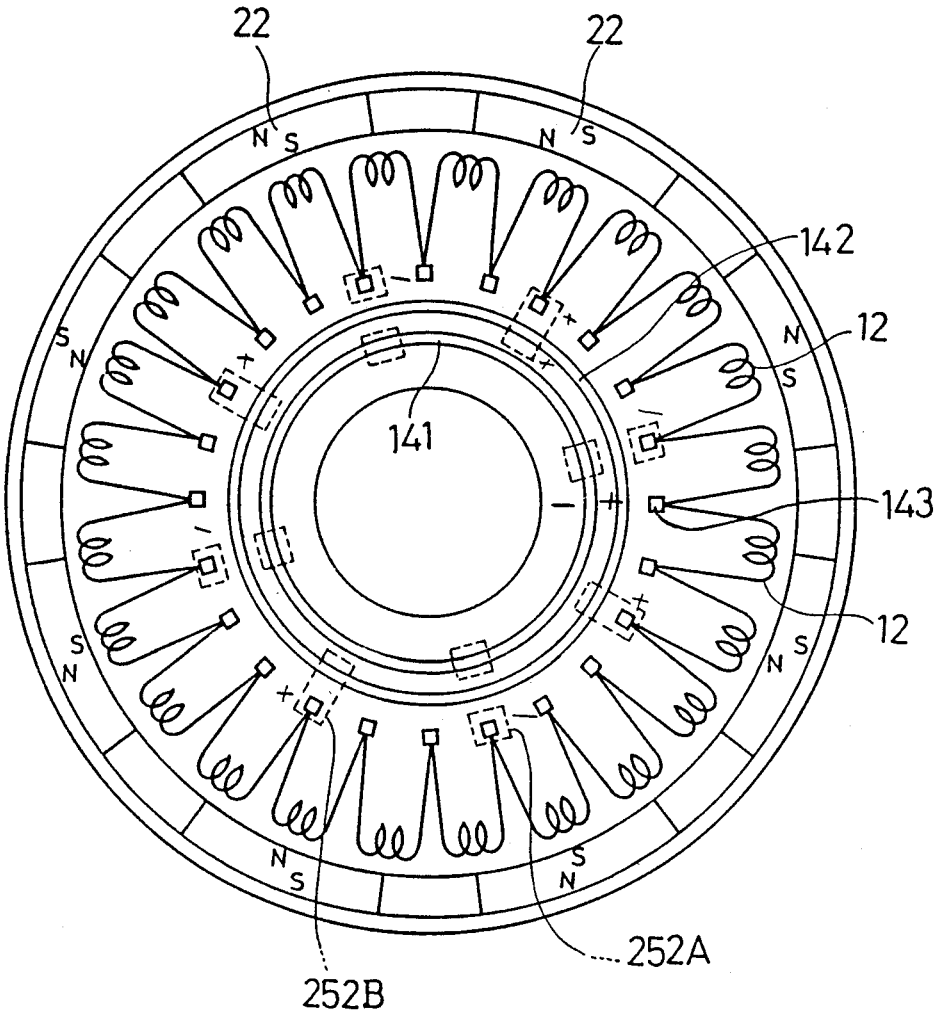
FIG. 7 is a schematic front view illustrating part of the electrical system electric generator of FIG. 1.

The electrical connections between the starting coils 12, the conduction paths 141, 142 and 143, and the brushes 252A and 252B, and the positioning of the brushes 252A and 252B are shown in FIG. 7. FIG. 8 schematically illustrates these electrical connections in a partial linear representation.

Referring to FIGS. 4 and 8, the operation of the above embodiment will now be described.

As a starter switch (not shown) is turned on to initiate the start-up sequence, the voltage of the power supply 90 is applied to the magnet 30 to energize it. Then the brushes 252 come into contact with the conduction paths 141, 142 and 143 of the starting current supply path assembly 14.

While the above start-up sequence is occurring, an electric current flows through the starting coils 12 in a predetermined direction according to a cooperative operation of the conduction paths 141, 142 and 143 and the brushes 252. For example, when the brushes 252 and the conduction paths 141, 142 and 143 are oriented as shown in FIG. 7, the electric current will flow from the brushes 252B to the brushes 252A through each starting coil 12. Thus the starting coils 12 will generate magnetic fields, as indicated by the arrows in FIG. 8, which point from N to S poles. The field magnets 22 provide constant magnetic fields oriented in the directions shown by the arrows. Hence, each set of three coils 12 positionally facing one magnetic pole 22 will, from left to right, give an attractive force and two repulsive forces to the rotor 20. The rotor 20 is then caused to rotate, and thus so are the brushes 252 themselves. Therefore, the brushes 252 will move to their next magnetic position where they switch the connections of the conduction paths 141, 142 and 143 thereby reversing the attraction-repulsion relationships and further causing the rotor to rotate. In this manner, every time the brushes 252 rotate to successive positions, they switch the connections of the starting coils 12, so that the above-described attraction-repulsion relationships again take place between the starting coils 12 and the field magnetic poles 22 so as to sustain continuous rotation of the rotor 20. The rotation of the rotor shaft 24 causes the crankshaft 40 to turn over the engine.

When the starter switch is opened after the completion of the start-up sequence for the engine, the electromagnet 30 is de-energized, and the conduction paths 141, 142 and 143 are offset from the brushes 252. The engine will continue running under its own power. The electric generator will then provide electric power to the vehicle through the generating coils 13 and the ongoing rotation of the rotor caused by the operating engine. Also, the starting coils 12 will serve as generating coils once the start-up sequence has been completed and the engine is running.

Figure 9:
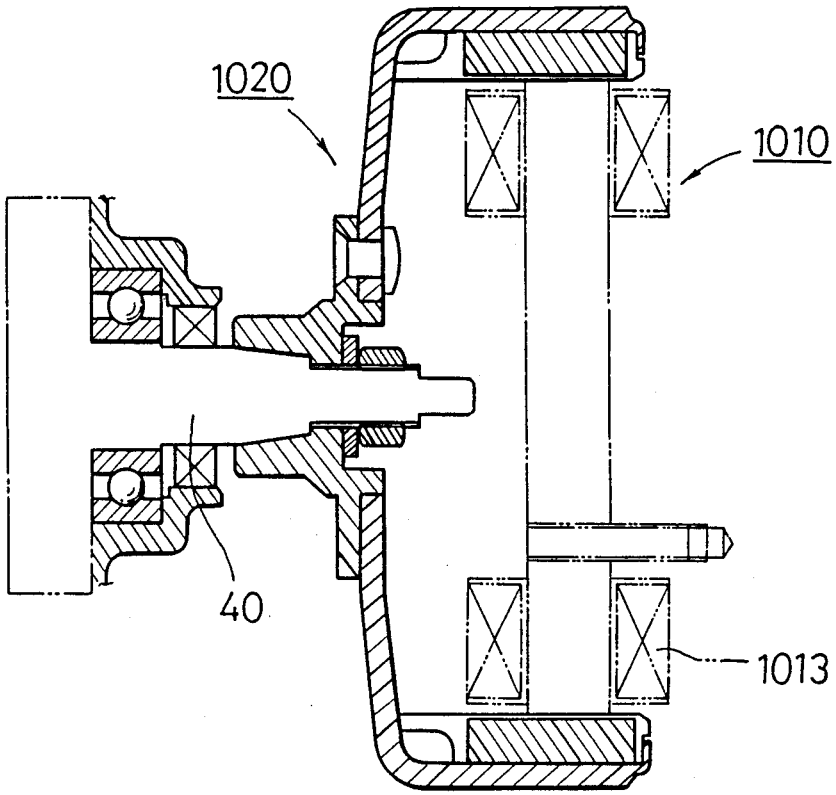
FIG. 9 is a sectional side view of a conventional electric generator.

FIG. 9 shows a conventional dynamo including a field magnet 1020 and an armature 1010 equipped with generator coils 1013. The conventional field magnet 1020 working as a rotor can be identical to the field magnet 20 used in the present invention.

In other words, the present invention can utilize conventional field magnets. This can be done by detachably mounting the rotor shaft 24 which slidably supports the brushes 252 on the crankshaft 40 and by arranging the outer diameter of the armature 10 to be the same as that of a conventional armature.

The connection and disconnection between the conduction paths 141, 142 and 143 of the starting current supply path assembly 14 and the brushes 252 may be attained by a repulsive force of the electromagnet 30, rather than an attractive force as provided in the described embodiment. The number of field magnets 22 can be other than eight.

A vehicular dynamo constructed according to the preferred embodiment provides starting coils and generating coils in the same magnetic circuit, means for successively switching the connections of the starting coils to a power supply in cooperative motions of the brushes so as to generate required torques, and means for detachably mounting the crankshaft from the rotor shaft which is connected to the brushes.

According to the preferred embodiment, the starter and the generator of a vehicular engine can be integrated so that components such as speed reduction shafts and starting clutches can be eliminated. This makes the dynamo more compact and lower in weight and provides for better control of quality during manuacturing.

Also, conventional field magnets can be used thus making the dynamo less expensive and more versatile.

Since the starter and generator functions are performed by the use of a common shaft and since the common shaft is directly connected with the crankshaft of the engine, a high starting efficiency is obtained.

Finally, since the brushes are disconnected after the start-up sequence has been completed, brush wear will be minimized and the maintenance of the brushes will be greatly reduced.

While embodiments and applications of the present invention have been set forth, one skilled in the art will realize that many more modifications are possible without departing from the inventive concepts herein. The invention, therefore, is to be given the full scope of the appended claims.

What is claimed is:

1. An electric generator for a vehicle having an engine, comprising:

an armature having starting coils and generating coils in common magnetic circuits and a starting current supply path assembly for supplying electric current from a power supply to said starting coils during a start-up sequence of the engine, a field element in coplanar relation to said armature and having a set of field magnets about said armature, said field element also having brushes electrically coupled between said starting current supply path assembly and said starting coils, said brushes being movably mounted relative to said starting current supply path to selectively disengage electrically therefrom, and means for moving said brushes into contact with said starting current supply path assembly to make an electrical connection during said start-up sequence, said armature and said field element being disposed normal to a crankshaft of said vehicle engine, and one of said armature and said field element being a stator and the other being a rotor connected with said crankshaft.

2. The electric generator according to claim 1, wherein said starting current supply path assembly includes first and second concentric conduction paths connected with electrodes of said power supply and a third conduction path connected with said starting coils, and said brushes including alternately first brushes for connecting said first and second conduction paths and second brushes for connecting said second and third conduction paths.

3. The electric generator according to claim 2, wherein said starting coils and said generating coils lie in common magnetic circuits.

4. The electric generator, of claim 3, wherein said rotor is directly connected with said crankshaft of said engine.

5. The electric generator according to claim 2, wherein said rotor is directly connected with said crankshaft of said engine.

6. The electric generator according to claim 1, wherein said rotor is directly connected with said crankshaft of said engine.

7. The electric generator of claim 1, wherein said rotor is directly connected with said crankshaft of said engine.

8. The electric generator according to claim 1, wherein said starting coils are also for generating electricity for the vehicle through said second magnetic field of said set of field magnets after said start-up sequence is completed.

9. An electric generator for a vehicle having an engine, comprising an armature having starting coils, generating coils and a starting current supply path assembly for supplying electric current from a power supply to said starting coils during a start-up sequence of the engine, a field element having a set of field magnets about said armature for generating a starting torque to start the engine and for providing a generating magnetic field, said field element also having brushes electrically coupled between said starting current supply path assembly and said starting coils, said brushes being movably mounted relative to said starting current supply path to selectively disengage electrically therefrom, a rotor shaft received in the center of said armature for supporting said brushes, an end of said rotor shaft being mounted on one end of a crankshaft of said engine in an integrally rotatable and axially detachable manner, and a set of at least one magnet for causing said brushes to slide along said rotor shaft during the start-up sequence so a to make an electrical connection with said starting current supply path assembly and for being de-energized so that the electrical connection caused by said brushes between said starting current supply path assembly and said starting coils can be broken at the completion of said start-up sequence, said armature being a stator and said field element being a rotor connected with said crankshaft of said engine.

10. The electric generator according to claim 9, wherein said starting current supply path assembly has first and second concentrical conduction paths connected with electrodes of said power supply and a third conduction path connected with said starting coils, and said brushes comprising alternately first brushes for connecting said first and second conduction oaths and second brushes for connecting said second and third conduction paths.

11. The electric generator according to claim 10, wherein said starting coils and said generating coils lie in common magnetic circuits.

12. The electric generator according to claim 11 wherein said rotor is directly connected with said crankshaft of said engine.

13. The electric generator according to claim 10, wherein said rotor is directly connected with said crankshaft of said engine.

14. The electric generator according to claim 9 wherein said starting coils and said generating coils lie in common magnetic circuits.

15. The electric generator according to claim 14, wherein said rotor is directly connected with said crankshaft of said engine.

16. The electric generator according to claim 9 wherein said rotor is directly connected with said crankshaft of said engine.

17. The electric generator according to claim 9, wherein said starting coils are also for generating electricity for the vehicle through said second magnetic field of said set of field magnets after said start-uo sequence is completed.

18. An electric generator for a vehicle having an engine, comprising an armature serving as a stator and having starting coils, generating coils and a starting current supply path assembly for supplying electric current from a power supply to said starting coils during a start-up sequence of the engine, a field element connected with a crankshaft of said engine as part of a rotor, having a set of field magnets about said armature for generating a starting torque to start the engine and for providing a generating magnetic field, brushes electrically coupled between said starting current supply path assembly and said starting coils during said start-up sequence, said brushes engaging said field element to rotate integrally therewith, and at least one magnet for causing said starting current supply path assembly and said brushes to make an electrical connection during said start-up sequence, said magnet also being for de-energizing after said start-up sequence is completed so that an electrical connection is broken between said starting coils and said starting current supply path assembly to obtain electrical energy from said generating coils by the rotation of said engine.

19. The electric generator according to claim 18, wherein said starting current supply path assembly has first and second concentrical conduction paths connected with electrodes of said power supply, and a third conduction path connected with said starting coils, and said brushes including alternately first brushes for connecting said first and third conduction paths and second brushes for connecting said second and third conduction paths.

20. Electric generator according to claim 19, wherein said first and second conduction paths of said starting current supply path assembly are provided with pins connected with lower sides of said paths, said pins being connected with a power supply via an adaptor plug.

21. The electric generator according to claim 20, wherein said starting coils and said generating coils lie in common magnetic circuits.

22. The electric generator according to claim 21, wherein said rotor is directly connected with said crankshaft of said engine.

23. The electric generator according to claim 20, wherein said rotor is directly connected with said crankshaft of said engine.

24. The electric generator according to claim 23, wherein said rotor is directly connected with said cranksahft of said engine.

25. The electric generator according to claim 18, wherein said starting coils and said generating coils lie in common magnetic circuits.

26. The electric generator according to claim 25, wherein said rotor is directly connected with said crankshaft of said engine.

27. The electric generator according to claim 18, wherein said rotor is directly connected with said crankshaft of said engine.

28. The electric generator according to claim 18, wherein said starting coils generate electricity for the vehicle through said second magnetic field of said set of field magnets after said start-up sequence is completed.

29. An electric generator for a vehicle having an engine and a crankshaft operatively connected to said engine, comprising:

an armature having starting coils, generating coils and a starting current supply path assembly including first and second concentric conduction paths electrically connected to a power supply and a third conduction path connected with said starting coils for conducting electric current between said power supply and said starting coils during a start-up sequence of said engine;

a field element having a set of field magnets about said armature and alternately disposed first and second brushes movably mounted with respect to said starting current supply path for selective electrical engagement and disengagement therefrom, said first brushes connecting said first and second conduction paths and said second brushes connecting said second and third conduction paths;

means for moving said brushes into engagement with said starting current supply path assembly during said start-up sequence and for disengaging said brushes upon completion of said start-up sequence, one of said armature and said field element being a stator and the other being a rotor connected with said crankshaft.

30. The electric generator according to claim 29, wherein said starting coils and said generating coils lie in common magnetic circuits.

* * * * *

UNITED STATES PATENT AND TRADEMARK OFFICE

CERTIFICATE OF CORRECTION

PATENT NO. : 4,754,154

DATED : June 28, 1988

INVENTOR(S) : SHOJI MOTODATE

It is certified that error appears in the above-identified patent and that said Letters Patent are hereby corrected as shown below:

On line 35, column 6, delete "a" and insert -- as --.

On line 7, column 7, delete "start-uo" and insert -- start-up --.

Signed and Sealed this

Twenty-eighth Day of February, 1989

*Attest:*

DONALD J. QUIGG

*Attesting Officer*

*Commissioner of Patents and Trademarks*